US006382869B1

(12) United States Patent
Dickinson

(10) Patent No.: US 6,382,869 B1
(45) Date of Patent: May 7, 2002

(54) ABOVE GRADE MASS DISPLACEMENT TRAFFICWAY BARRIER

(76) Inventor: Harry D. Dickinson, 24901 W. Ave. Standford, Valencia, CA (US) 91355

( * ) Notice: Subject to any disclaimer, the term of this patent is extended or adjusted under 35 U.S.C. 154(b) by 0 days.

(21) Appl. No.: 09/458,165

(22) Filed: Dec. 9, 1999

(51) Int. Cl.[7] ..... E01F 13/02; E01F 13/04; E01F 13/12

(52) U.S. Cl. ..... 404/6; 49/9; 49/34

(58) Field of Search ..... 404/6, 9, 10; 244/110 A, 244/110 C, 110 F, 110 R; 49/34, 131, 9; 256/13.1

(56) References Cited

U.S. PATENT DOCUMENTS 4,056,247 A * 11/1977 Bernard et al. ..... 244/110 C
4,456,205 A * 6/1984 Alavoine et al. ..... 244/110 C
4,490,068 A * 12/1984 Dickinson ..... 404/6
4,574,523 A * 3/1986 Nasatka ..... 49/49
4,630,395 A * 12/1986 Nasatka ..... 49/49
4,752,152 A * 6/1988 Crisp et al. ..... 404/6
4,826,349 A * 5/1989 Nasatka ..... 404/6
4,828,424 A * 5/1989 Crisp, Sr. ..... 404/6
4,844,653 A * 7/1989 Dickinson ..... 404/6
4,979,701 A * 12/1990 Colarik et al. ..... 244/110 C
5,009,542 A * 4/1991 Hardin, Jr. et al. ..... 404/6
5,245,787 A * 9/1993 Swenson et al. ..... 49/34
5,466,088 A * 11/1995 Nasatka ..... 404/6
5,829,912 A * 11/1998 Marcotullio et al. ..... 404/6
5,993,104 A * 11/1999 Marcotullio et al. ..... 404/6

* cited by examiner

*Primary Examiner*—Thomas B. Will
*Assistant Examiner*—Alexandra K. Pechhold
(74) *Attorney, Agent, or Firm*—Roger A. Marrs

(57) ABSTRACT

An above-grade trafficway barrier adapted to arrest heavy vehicles, with an obstruction member extending between opposite sides of the trafficway, and controlled by its known mass deposed upon the grade level and preferably by spaced inertia blocks deposed at opposite sides of the trafficway, the known mass not to exceed the strength of the obstruction member and coupling thereof regardless of the vehicle mass. Impact force being gradually applied and dissipated by the known mass through a lever system with simultaneous roll, turn and sliding movements of said spaced masses; whereby the obstruction member is not subjected to greater force exerted by the impacting vehicle.

6 Claims, 7 Drawing Sheets

ABOVE GRADE MASS DISPLACEMENT TRAFFICWAY BARRIER

This application is application Ser. No., 09/442,320 filed Nov. 22, 1999, now abandoned entitled BELOW GRADE MASS DISPLACEMENT TRAFFICWAY BARRIER.

The primary object of this invention is to arrest a heavy vehicle traveling at high velocity, by means of an obstruction member extending transversely of a trafficway and subject to the inertia of an above grade mass. In a first and basic embodiment of the barrier is an integral mass as taught in U.S. Pat. No. 4,490.068. In a second and preferred embodiment the mass is separated by an obstruction member as taught in U.S. Pat. No. 4,844,653. Force is applied to and dissipated by the obstruction member of either embodiment and limited to the mass inertia thereof, and in the second embodiment the separated masses are in equilibrium with each other, whereby in either embodiment the obstruction member is subjected only to the yielding mass, the greater impacting force of the vehicle being absorbed in accelerating the mass or masses of this apparatus.

BACKGROUND OF THE INVENTION

This invention relates to anti-terrorist barriers capable of stopping the movement of vehicles unauthorized to enter through a trafficway, and is an improvement over the aforementioned U.S. Patents, wherein the barriers are fixedly installed below grade, and wherein means is provided to fixedly anchor an arresting cable to opposite sides of a trafficway. This prior art also provides means that swivels the cable carrying beam at a first side of the trafficway, to rotate in a horizontal plane during impact. And this prior art also teaches the use of frangible parts at what is termed the pivot block of the semiphore device, so as to permit horizontal rotation thereof upon vehicle impact. And characteristically, this prior art teaches fixedly positioned barriers and cable anchor means, the structure being cemented into fixed positions below grade.

A vehicle moving toward a barrier of the type under consideration has kinetic energy which is calculated by the vehicle gross weight times the square of its velocity, and upon impact with such a barrier this kinetic energy is then converted into heat, sound and mainly into the deformation and destruction of the vehicle whereby the vehicle is demolished. And in accordance with this invention the barrier has inertia that is absorbed by the kinetic energy released upon vehicle impact with an obstruction member of the barrier. In actual practice, the total energy dissipated depends upon varying factors prevailing at the time of impact, all of which need not be detailed here. For example, the barrier shown and described herein will destroy a 15,000 pound (gross) weight vehicle impacting at a velocity of 30 MPH and much more. And it is to be understood that vehicles vary greatly in weight and structural durability, that trafficway alignment will vary, and that vehicle velocity can be more or less than the example given here. Accordingly, it is a general object of this invention to provide a yielding barrier, characterized by its shiftable mass. In the second and preferred embodiment said mass is comprised of spaced inertia blocks between which and obstruction member is visibly carried by a retractile semiphore beam.

This barrier can take various gate type forms and is shown herein as a semiphore beam that carries a hidden obstruction member having improved properties to extend across a trafficway between massive inertia blocks to which it is joined in a "closed" and effective position. In the "open" ineffective position the obstruction member is detached from one inertia block and swings away from the other inertia block, the two massive inertia blocks being at opposite sides of the trafficway. The barrier is also shown in its basic form as a rigid above grade structure extending transversely over the trafficway surface, wherein the obstruction member is a wall that is raised and lowered within a rigid and permanent frame structure.

An object of this invention is to effectively tie two masses together with a vehicle obstruction therebetween, and all of which are inseparable upon vehicle impact. In practice therefore, the obstruction is a flexible member of great strength and which conforms to vehicle deterioration during impact. And the masses are blocks that are shiftable upon vehicle impact according to the magnitude of the kinetic energy absorbed thereby.

It is a primary object of this invention to totally arrest motion of the impacting vehicle. And, upon slight impact the system yields if at all and shifts very little, whereas upon great impact the system yields and shifts substantially. The flexible obstruction member then becomes a snare attached to spaced massive inertia blocks and each of which is shiftable and subject to displacement from its initially deposed position. In accordance with this invention, it is therefore an object to provide repositionable inertia blocks subject to displacement when arresting the momentum of a vehicle to an absolute stop.

It is an object of this invention to provide a beam support for the flexible obstruction member in the form of a chain, by which the chain is retractably carried to fasten between the two shiftable inertia blocks, the chain being an improved obstruction member as hereinafter described. The beam is tubular so as to enclose, support and hide the chain, and it is adjustable as to length so as to accomodate the attached effective length of said chain. In practice, the beam is an extension tube that is expendable after a vehicle impact and which telescopes into a yoke tube that is swiveled so as to swing as a semiphore away from its operative transverse position. The extension tube is initially straight and guides end links of the chain into alignment with clevis pins by which the supported chain is detachably secured to the inertia blocks at opposite sides of the trafficway.

This barrier system provides a pair of spaced massive above grade inertia blocks from each of which a vertical column projects for the attachment of the obstruction member extending therebetween above the trafficway. Each vertical column is preferably a steel weldment approximately 30 inches tall (above grade) secured to a steel frame to which the inertial mass is assembled. The assembly remains free and detached from the grade level upon which it is deposed.

It is an object of this invention to provide yieldable placement of the above surface mass or spaced masses of this barrier system. In the spaced block embodiment, predetermined absorbtion of kinetic energy as caused by vehicle impact requires control of two factors; 1) the inertia of the individual blocks, the levers and obstruction member assembled therebetween; and 2) the friction properties of the interfaces of the spaced masses with the grade surface upon which they are deposed.

In accordance with this invention the spaced blocks simply rest upon the grade surface such as concrete or asphalt paving, soil, or any such combination thereof. To this end the massive structural weight or weight of the blocks are displaced according to the deceleration forces applied during the transfer of momentum when absorbing kinetic energy as a result of vehicle impact, followed by frictional retardation of said blocks as kinetic energy that is completely dissipated. A feature herein is the total release of kinetic energy as a result of deceleration of the vehicle velocity to a fully stopped condition.

Heretofore, the obstruction member of gate type semiphore barriers has been a steel cable carried by a tubular beam extending between a pivot post rigidly cemented into a permanent foundation at one side of a trafficway, and a bit post rigidly cemented into a permanent foundation at the other side of the trafficway. Accordingly, the prior art barrier systems have been predicated upon immovable foundation blocks with frangible parts, and limited in vehicle impact momentum. As a result, permanent foundation blocks shift and are tilted out of alignment and therefore require rebuilding. And, steel cable fails and is "snapped" when impacted by heavy high speed vehicles. It is an object of this invention therefore to provide a barrier system that avoids major replacement of structure by combining said structural members so as to avoid damage and which are readily re-aligned with the trafficway, and above all an obstruction member in the form of a chain.

SUMMARY OF THE INVENTION

The elements essential to this invention are the singular or multiple above grade mass and the obstruction member coupled thereto and extending transversely of the trafficway. It is the controlling planar interfaced deposition upon and frictional engagement with the supporting grade surface that characterizes this barrier concept.

This is a crash rated wall or gate type vehicle, barrier system that can be quickly deployed or relocated as circumstances require for manual or automatic operation. The mass or masses do not require any excavation or foundation construction. The inertial mass is either an integral structure or separate masses located at opposite sides of the trafficway and assembled of interlocaking sections from which spaced posts extend upwardly to suspend the obstruction member therebetween. The assembly can be filled in situ with concrete, sand, gavel or other available mass media or alternately at a remote location or at the point of manufacture. Each weighted assembly presents a significant mass as may be required, whereas an unfilled assembly is lightweight for shipping. Each assembly has features for forklift handling etc., and the systems can be operated manually or by fully automatic control.

The foregoing and various other objects and features of this invention will be apparent and fully understood from the following detailed description of the typical preferred forms and applications thereof, throughout which description reference is made to the accompanying drawings.

THE DRAWINGS

Figure 7A:
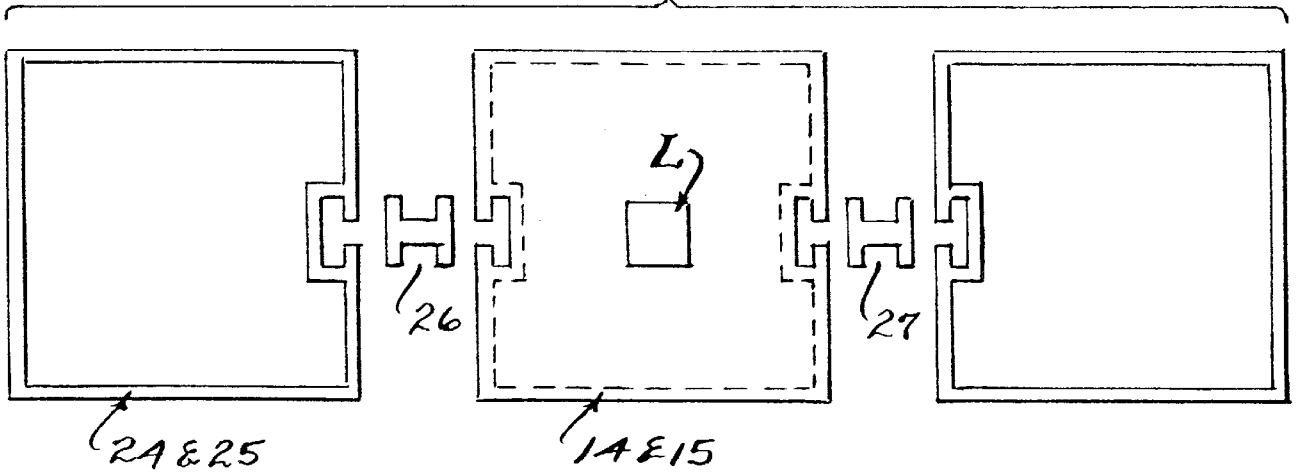
Figure 7B:
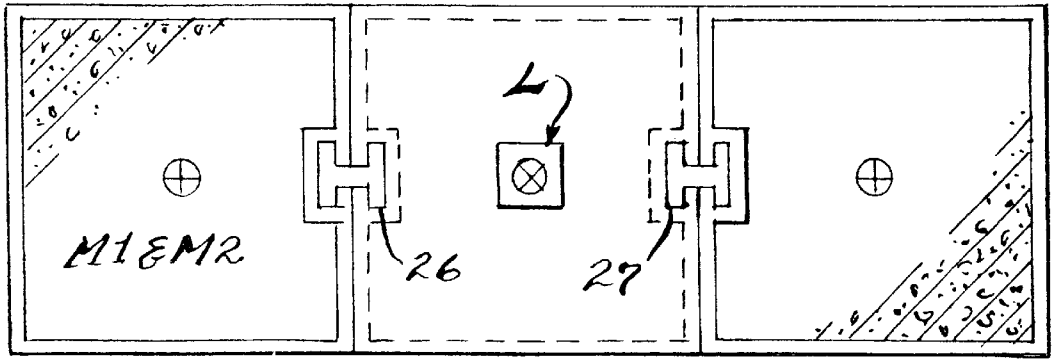

FIG. 7*a* is an exploded view of the sectional body mass at one (either) side of the trafficway, and FIG. 7*b* is an assembled view thereof.

Figure 8:
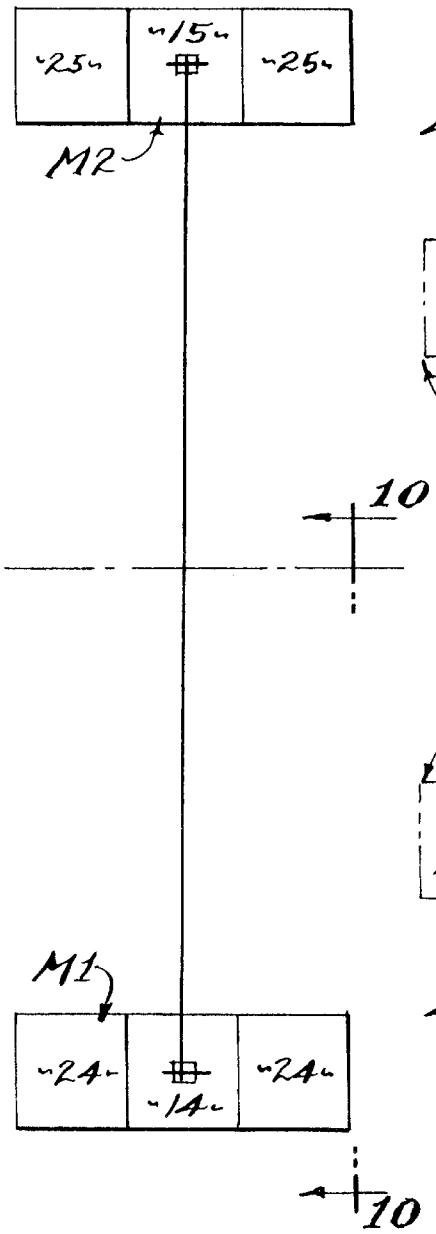
Figure 9:
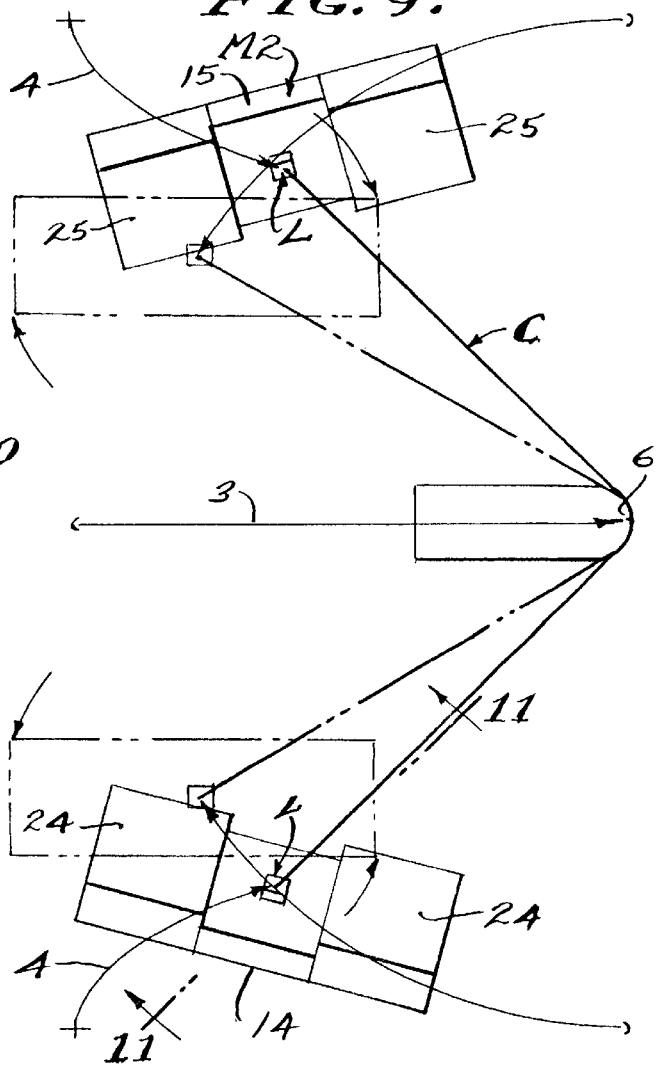

FIGS. 8 and 9 are diagramatic plan views illustrating the initial barrier installation followed by its condition in the process of and after arresting a vehicle, respectively.

Figure 10:
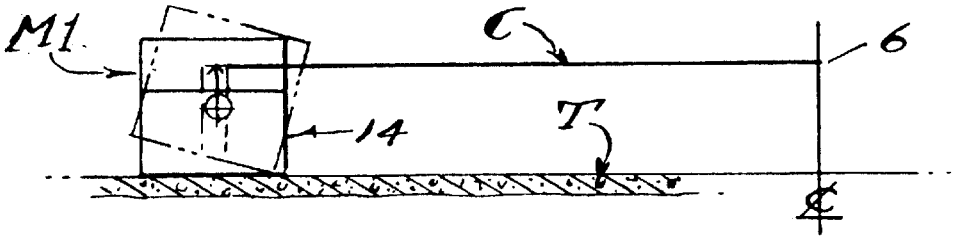
Figure 11:
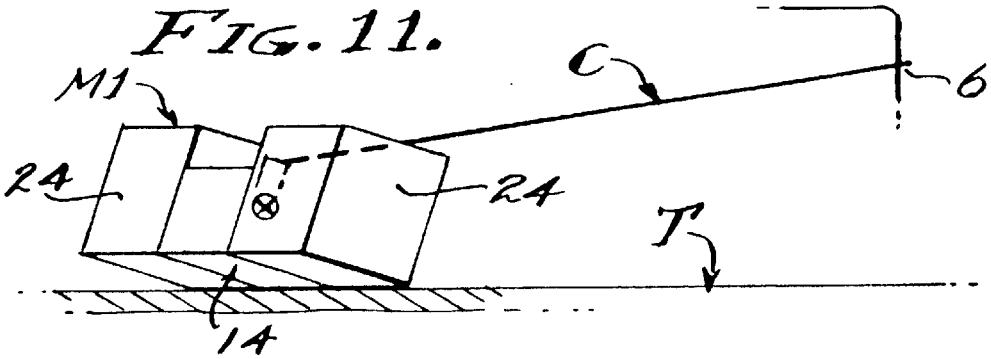

FIG. 10 is a sectional view showing the initial inertial mass deposition taken as indicated by lines 10—10 on FIG. 8, and FIG. 11 is a view showing the arrested inertial mass taken as indicated by line 11—11 on FIG. 9.

Figure 12:
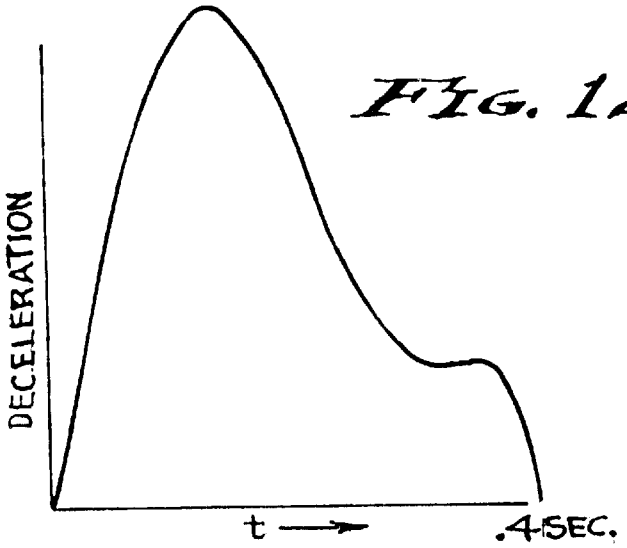

And, FIG. 12 is a graph illustrating a typical deceleration curve of the vehicle mass in accordance with this invention.

PREFERRED EMBODIMENTS

This above grade trafficway barrier is comprised primarily of cost effective indestructible parts together with several expendible parts. Two embodiments are disclosed herein, 1) an integral unit mass comprised of a rigid frame and deployable barrier wall, and 2) a separeable apparatus comprised of spaced blocks joined by a conforming barrier member. A feature of these barrier is the free deposition of a displaceable mass, singular or multiple, to rest upon the surface of the trafficway and subject to frictional interface engagement therewith As a result, the barrier member sees or is subjected to a predetermined maximum force limited to the capacity of the barrier unit or apparatus, which is greater than the force generated by the impacting vehicle.

Figure 1:
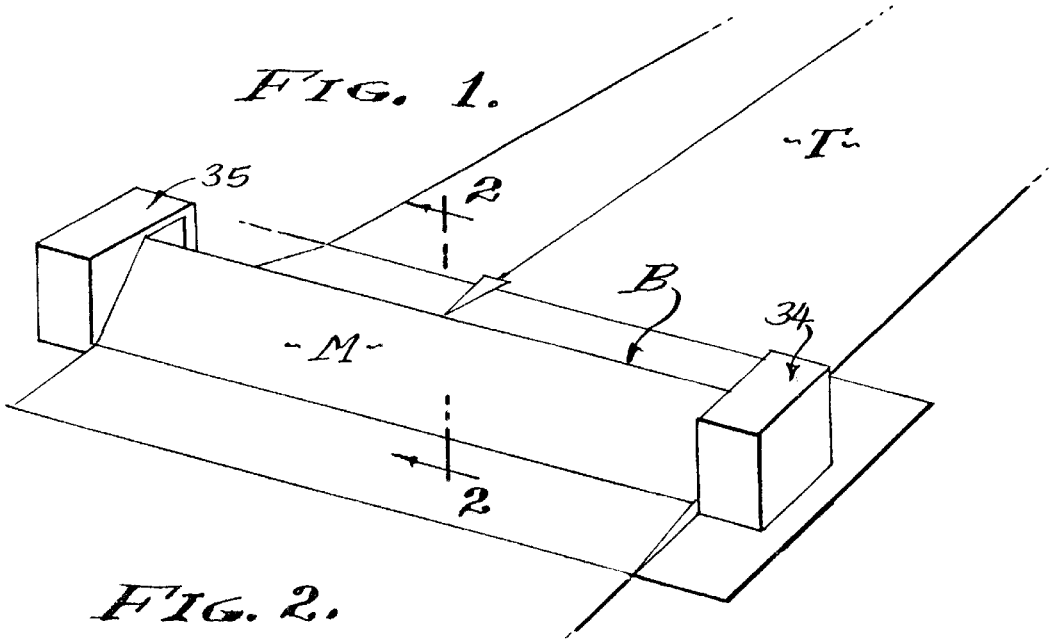
FIG. 1 is a perspective view of a basic above grade placement of a rigid wall type barrier in a deployed position for stopping unauthorized vehicular traffic.
Figure 2:
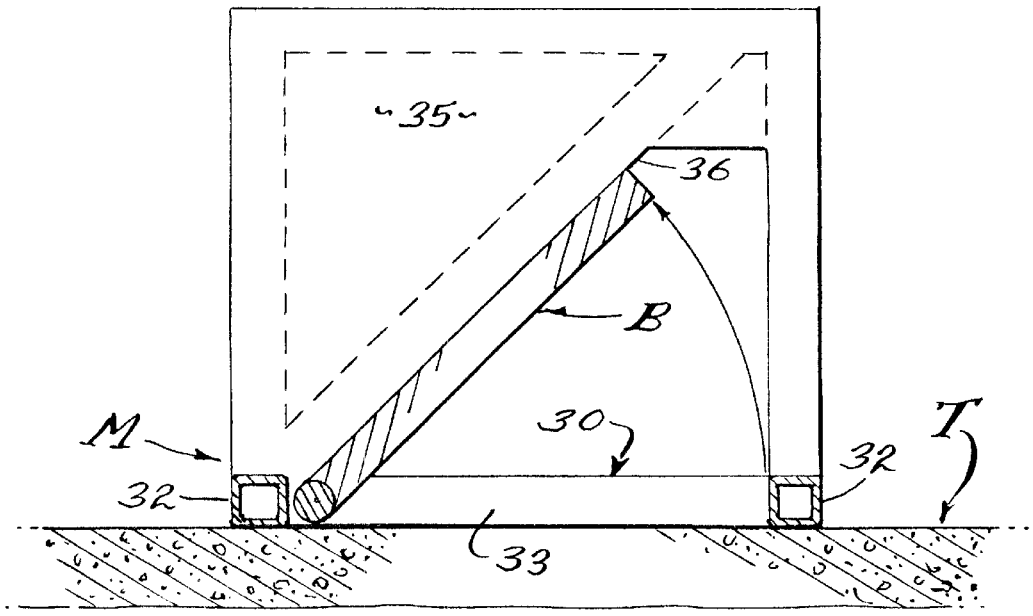
FIG. 2 is an enlarged sectional view taken as indicated by line 2—2 on FIG. 1 and illustrating deposition of the barrier structure free upon the trafficway surface.

Referring now to FIGS. 1 and 2 of the drawings, the basic concept of a freely deposed trafficway controller of integral construction is shown placed across a trafficway T. The controller is comprised of a barrier B mounted upon and carried by a mass M in the form of a frame 30. In this embodiment the barrier is a heavily contructed wall that is raised and lowered mechanically as by remotely controlled hydraulics (not shown), and the combined frame 30 and barrier B presents a single integrated mass M which is critical to arresting a vehicle impacting against said wall barrier B. As shown in FIG. 2, the frame 30 is comprised of a flat above grade base having spaced surface engaging support members 32 extending transversely of the trafficway T and separated by members 33 so as to accomodate the barrier wall B when it is lowered therebetween (not shown lowered). At either side of the trafficway there are upstanding housings 34 and 35 to accomodate operating means and to provide stop members 36 to limit the raised position of the barrier wall B. The frame members 32 and 33 are simply deposed upon the surface of the trafficway T so as to have flat interface frictional contact therewith, there being no structure-to-ground fastening of any kind. Accordingly, the mass M of the integral structure including the frame 30 and barrier B yields to an impacting vehicle so as to be accelerated from its initially deposed position, commensurate with the transfer of momentum resulting from the release of kinetic energy in the process of decelerating the impacting vehicle. The collapsing vehicle being decelerated provides the energy which is transfered.

Figure 3:
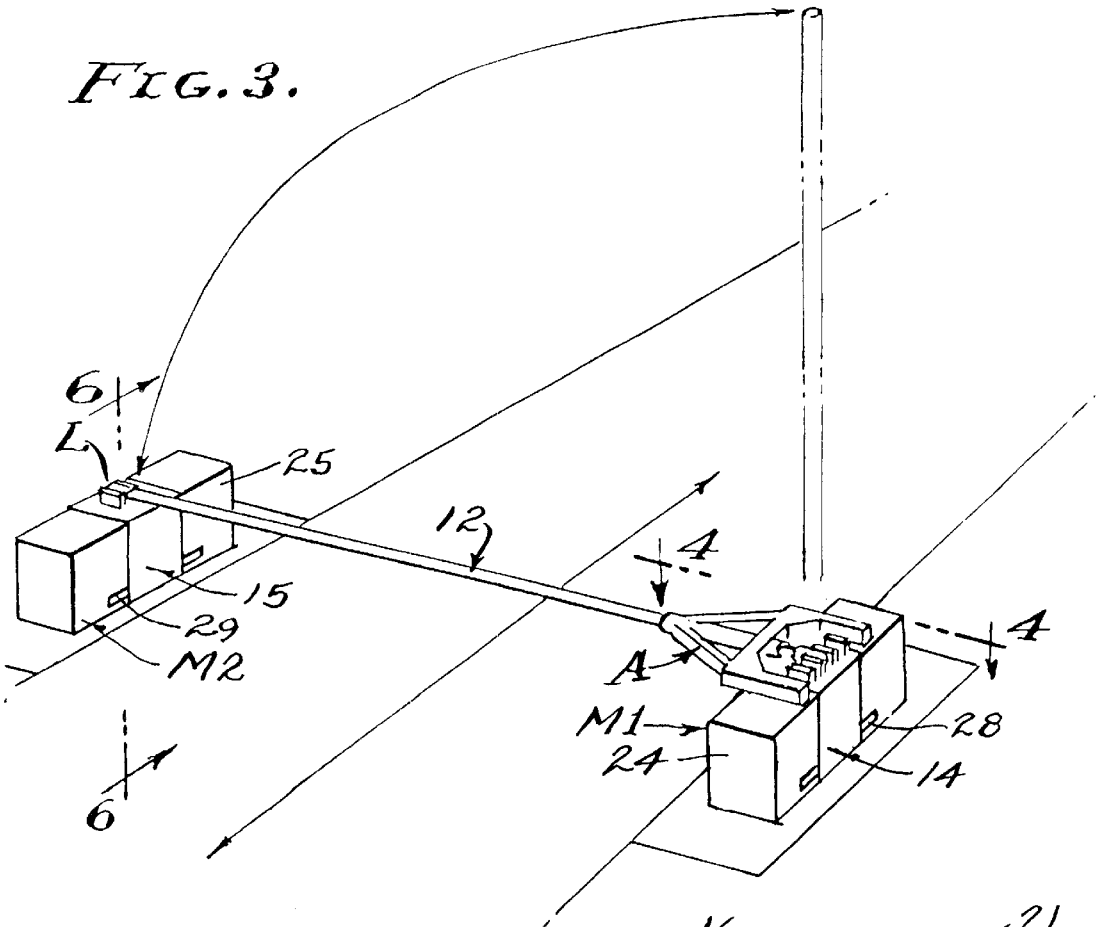
FIG. 3 is a perspective view of a second and preferred embodiment of the above grade trafficway barrier deposed upon a trafficway and in a CLOSED condition, the OPEN condition shown in phantom lines.
Figure 4:
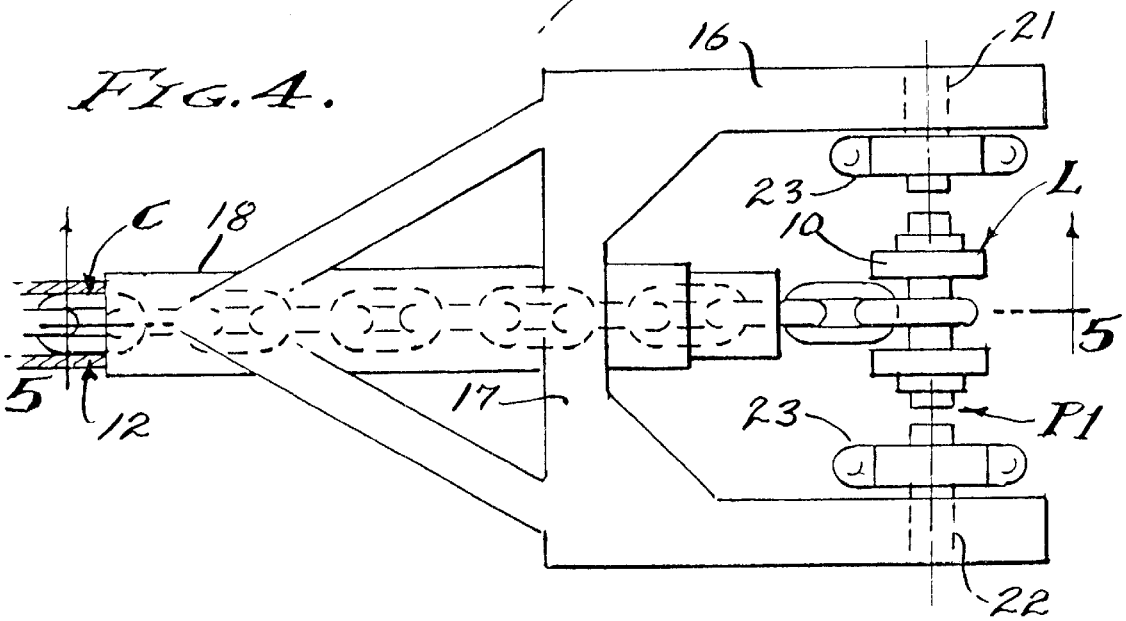
FIG. 4 is an enlarged plan view at the pivot end of the obstruction member, taken as indicated by line 4—4 on FIG. 3.

Referring now to the second and preferred embodiment shown generally in FIG. 3 of the drawings, an obstruction member C is hidden within a tubular beam 12 and extends between spaced inertia blocks M1 and M2, one at each side of the trafficway. Block M1 is coupled to one end of the obstruction member C and mounts a yoke A that is rotatably attached to swing said member away from a CLOSED effective position, and also to yield to impact through frangible bearing means as heretofore practiced in the art. Block M2 secures the remote end of the obstruction member C carried by the beam 12 into and out of the effective CLOSED position. A feature of this invention is the placement of two substantially identical above grade masses at opposite sides of the trafficway, and lever means L applying impact force thereto through the obstruction means C coupled to said lever means. The obstruction meaber C is flexible and pivotally pinned to each of the lever means L. A feature is the adjustable disposition and repositioning of the major elements of this barrier which are not damaged under normal vehicle impact. Slight impact is not damaging, and the frangible parts of this barrier are easily replaced.

This embodiment is characterized by a semaphore type arm, in the form of the tubular beam .12 that carries the obstruction member C between the inertia blocks M1 and M2 at opposite sides of the trafficway. The beam is pivoted at inertia block M1 separate from its lever means L, and it extends to inertia block M2 separate from its lever means L. A feature of this invention is that the beam 12 is destructable and expendable, permitting its breakaway and displacement from the inertia block M1, and separate from the lever mens L at both inertia blocks.

In accordance with this invention, at one side of the trafficway there is an upstanding frame 14 affixed to a sectional inertia block M1, said frame being integral with and surrounding the lever means L. The frame 14 carries frangible bearing means 23 to which the beam 12 is replaceably carried by a yoke A. And separately, there is an upstanding post 10 of lever means L to which the obstruction member C is coupled by a pin P1. It is preferred that the axes of the beating means 23 and of the pin P1 are coincidental, horizontal and normal to the extending axis of the beam 12, or nearly so.

And accordingly, at the other side of the trafficway there is an upstanding frame 15 affixed to a sectional inertia block M2 to which a remote end of the beam 12 is closely positioned so as to expose the terminal end chain link of the obstruction member C. And, there is an integral upstanding post 11 of the lever means L to which said terminal end link of the obstruction member is coupled by pin P2. The axis of pin P2 is horizontal and normal to the extended axis of the beam 12.

The sectional blocks MI and M2 are alike, so that a description of one will suffice for either. It is preferred that the assembled blocks M1 and M2 are of rectangular configuration, though other configurations are acceptable. In practice, each sectional inertia block M1 and M2 is comprised of detachable sections, a center section frame 14 and 15 respectively, and a pair of embracing mass containment sections 24 and 25 respectively. As shown, each section is a cube approximately three (3) feet square and adapted to be coupled together in groups of three by means of keys 26 and 27 respectively. Opposite sides of the frame 14 (15) interface with the opposing sides of a pair of containment sections 24 (25), there being complementary keyways formed in the interfacing sides of the sections to receive said keys which are removably inserted vertically into stopped positions as shown.

According to the above, the aforesaid sections can be assembled, disassembled and reassembled as may be required. A feature is the fork-lift openings 28 and 29 to facilitate transport and depositioning of the assembled inertia blocks M1 and M2. Another feature of each mass containment section 24 and 25 is that it can be shipped as an empty box adapted to be burdened or charged with mass material in situ, thereby facilitating shipment and reducing costs. The burden or mass in the form of poured concrete, rock, gravel or sand, establishes an inertia mass at each assembled block M1 and M2 of approximately 4200 Lbs. The top planes 13 of sections 24 and 25 are coplanar as shown.

The lever posts 10 and 11 are steel columns disposed on vertical axes extending through the center of gravity of the assembly and between the tops 13 and bottom 33 of each assembly, thereby establishing longitudinal and vertical axes of rotation about which the blocks M1 and M2 roll and turn as will be described.

Figure 5:
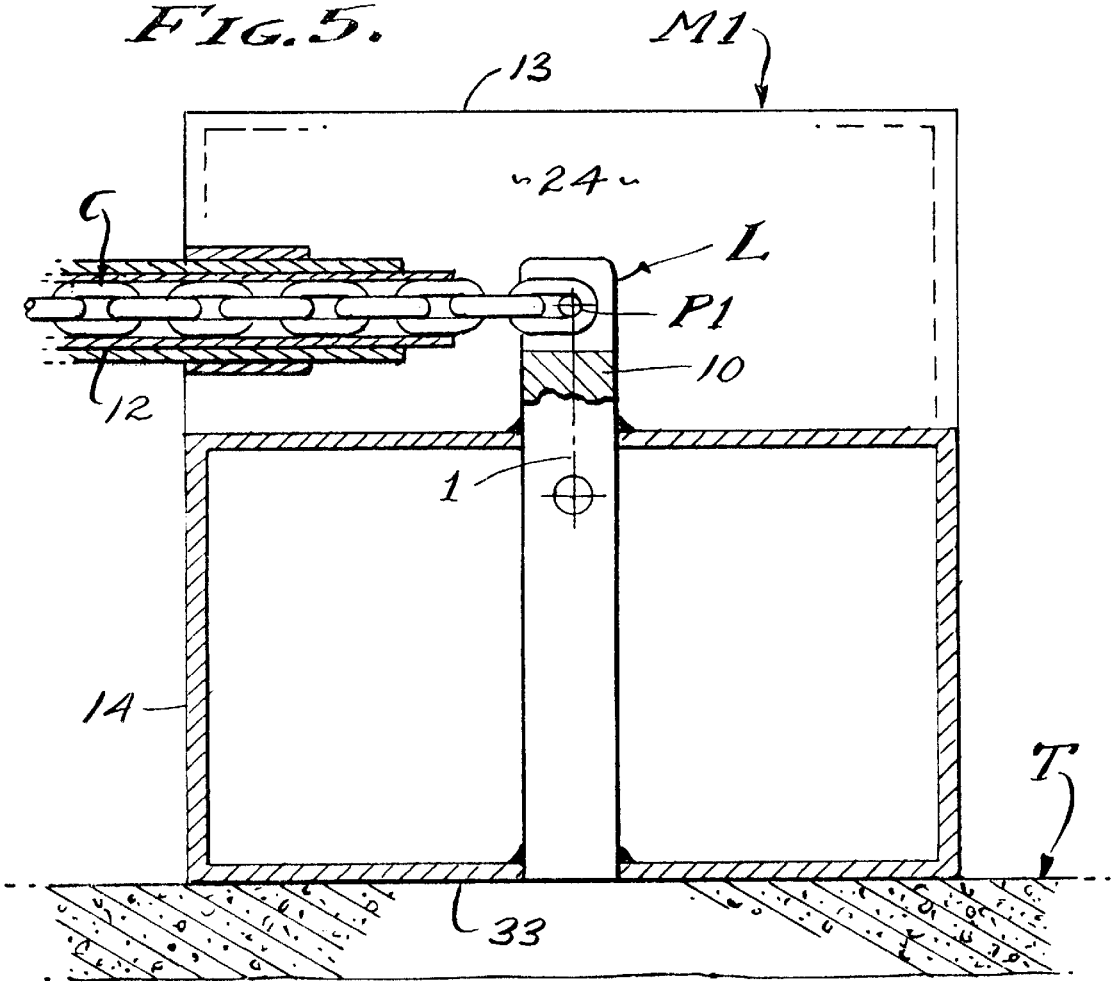
FIG. 5 is an enlarged elevation of the obstruction member taken as indicated by line 5—5 on FIG. 4.
Figure 6:
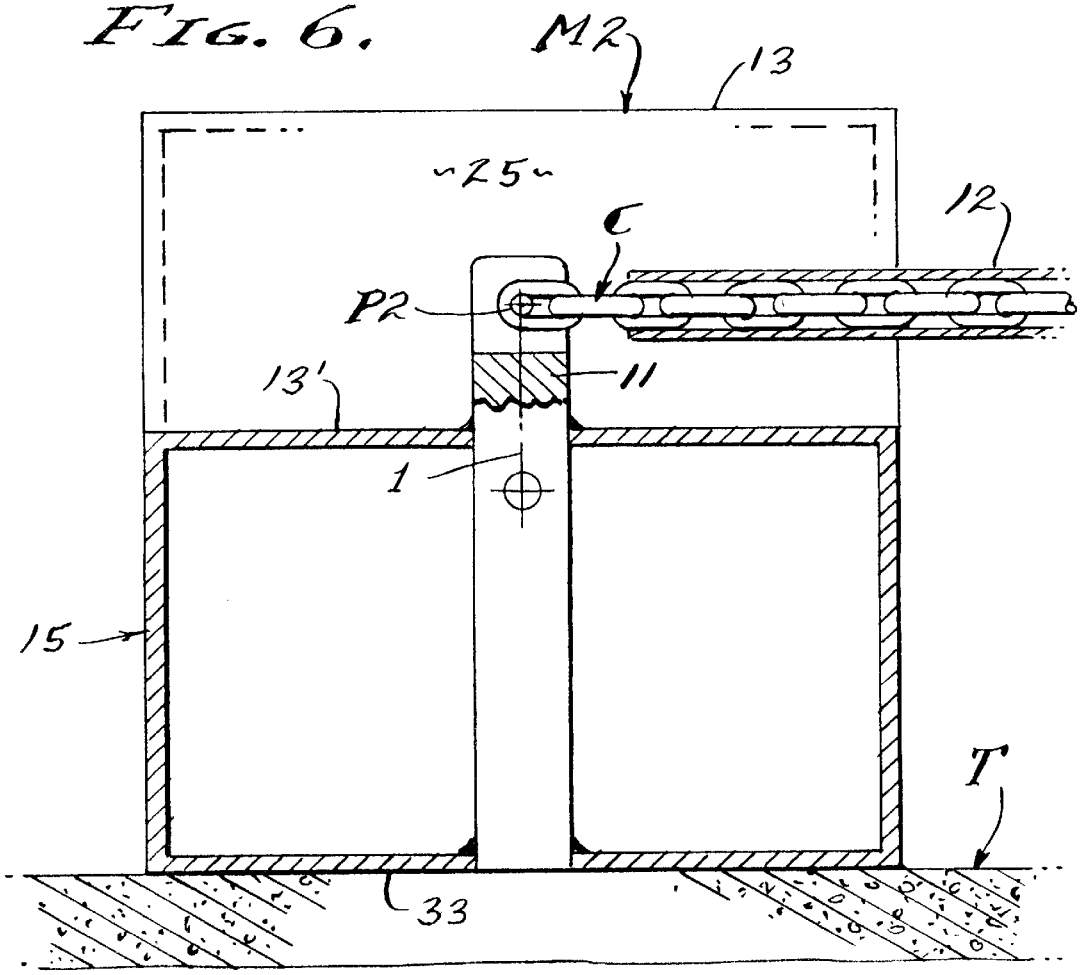
FIG. 6 is an enlarged elevation taken as indicated by line 6—6 on FIG. 3.

The posts 10 and 11 terminate at or below the planar tops 13 of the inertia block sections 24 and 25, to couple to the obstruction member C supported by the beam L2. Significantly, the moment arm 1 about the horizontal roll axis is minimized. As shown, the top end portion of each post 10 and 11 is bifurcated and with aligned openings to form a clevis for receiving a coupling pin. In practice, the posts 10 and 11 suspend the obstruction member C a distance above grade that will ensure that said member C will ride over the tired front wheels of large vehicles, for example approximately 30 inches above grade in order to subsequently snare the taller vehicle engine. Accordingly, the top 13' of the center frame section 14 (15) is recessed (see FIGS. 5 and 6) below the coplanar tops 13 of the containment section 24 (25) so as to position the coupling pins P1 and P2 as described. Small compact vehicles have tired wheel diameters of approximatey 24 inches and engine heights of approximately 30 inches, in which case said 30 inch abutment member C may drag through and subsequently snare the collapsing vehicle body.

The yoke $_A$ is comprised of spaced arms 16 joined by a header 17 from which the two arms extend rearwardly. A tubular socket member 18 projects forwardly from the center of the header to telescopically adjust the beam 12 on an axis intersecting the transverse pivotal axis of the aforesaid bearing mans 23. Trunnions 21 and 22 project coaxially inwardly from arms 16 respectively and stop short of the coupling pin P1, said trunnions being on a common axis coincidental with the transverse axis of said coupling pin.

The beam 12 is preferably a metal tube, or plastic, telescopically received in and supported by the socket member 18, by means of which it is readily replaced.

The bearing mans 23 are commercial light duty (cast iron) pillow blocks, so as to be frangible and replaceable at low cost.

The improved obstruction member C is chain, as shown throughout the drawings, which is discovered to be superior to steel cable used by the prior art. This is not to preclude cable when its properties are sufficient, nor is this to preclude structural members such as a tube or flexible beam. However, it is necessary that the obstruction member be flexible or bendable so as to conform to the interface of the vehicle impacting therewith. But cables do snap and fail under high impact loads whereas chain does not so readily since it has greater mechanical resilience than cable, which benefits its use as the barrier obstruction member C herein, whereby impacts are absorbed without failure that would otherwise destroy the equivalent cable, or the aforementioned obstruction member. Also, the coupling feature herein using simple clevis pins P1 and P2 in shear maximizes coupling strength and reliability. Accordingly, chain is the preferred obstruction member C.

In accordance with this invention, the obstruction member C is a flexible chain that is supported unloaded between coupling pins P1 and P2 at the top clevis ends of the posts 10 and 11, which are the work or force ends of lever means L that characterizes this vehicle arresting barrier. Each post 10 and 11 is essentially a Third Class lever, wherein the fulcrum is at the center of the mass, or center of gravity, of the inertia blocks M1 and M2, and wherein the mass inertia is the resistance of said blocks at a greater radii than that of the moment arms 1 at the chain connection pins P1 and P2. Power or force is simultaneously applied at the coupling pins P1 and P2 at the top ends of the posts (see FIGS. 5 and 6), with minimized moment arms 1 about a roll and a turn axes. Since the moment arms extend from both the hoizontal and vertical axes of rotation, simultaneous rolling and turning of the two inertia blocks M1 and M2 can occur as clearly shown. The moment arm about the vertical turn axis is nonexistent until and increases slightly only as a result of rolling about the horizonatl axis. Accordingly, there is a tendency for the inertia blocks M1 and M2 to roll inwardly and then to simultaneously turn in the direction of impact as clearly shown in FIGS. 10 and 9.

In practice, there are two (2) distinct axes of rotation passing through the center of gravity of each sectional inertia block (see FIGS. 10 and 9), the horizontal axes of rotation for possible rolling of the masses M1 and M2 toward the center of the trafficway (see the phantom lines in FIG. 10), and the vertical axes of rotation for possible turning of the masses angularly and/or diagonally with respect to the direction of the trafficway (see FIG. 9). Accordingly, moment arms are rotatable on said horizontal and vertical axes of inertia blocks M1 and M2. And referring to the graph FIG. 12, vehicle impact occurs over a period of time related to velocity during which the vehicle is decelerated from a high velocity to stopped condition. Impact duration of a 15,000 lbs. vehicle from a velocity of 30 MPH has been determined to be appoximately 0.58 sec.

The initial deposed positions of the posts 10 and 11 of the lever means L are vertical, from which the masses tend to roll inwardly on horizontal axes, as a result of tension force gradually and increasingly applied to the flexible chain obstruction member C when vehicle impact displaces said member at or near its midpoint 6 (see FIGS. 8 and 9). The force of impact is dynamic by which the position of applied force from the high velocity vehicle at point 6 moves forwardly as shown by arrow 3 in FIG. 9.

A feature of this invention is that the obstruction member C is of fixed length, the tension forces being applied in straight lines from a force application point 6 to pins P1 and P2, and due to the possible and actual roll and turn of the masses about their horizontal and vertical axes of rotation, the effective moment arms of the posts 10 and 11 of lever means L decrease as said masses roll and turn and are rapidly accelerated from their initially deposed positions (see FIGS. 9 and 11 ). In practice, this acceleration of the masses M1 and M2 to the positions shown in full lines in FIG. 9 occurs within approximately two feet of vehicle motion following the instant of initial contact of the vehicle with the obstruction member C.

The pins P1 and P2 move dynamically from the initial deposed positions shown in FIGS. 8 and 10 to the displaced positions shown in FIGS. 9 and 11, the locus of that movement being indicated generally by, the arrows 4 in FIG. 9 to positions of the blocks M1 and M2 as they begin to implode and "crush" into the opposite sides of the vehicle body (not shown). The inertia blocks M1 and M2 accelerate rapidly through the displaced positions shown by full lines in FIG. 9 and continue to converge angularly as shown by phantom lines in FIG. 9, thereby crushing the vehicle body.

The angular momentum of the converging inertia bodies M1 and M2 is rapidly decreased by the crushing effect on the vehicle body, whereupon said blocks drop by gravity so as to strike and dig into the surface of the trafficway and drag frictionally thereon until vehicle momentum is completely arrested. This dragging function occurs over a distance of approximately eight feet, the total distance of-vehicle movement from initial contact with the obstruction member C being approximately 15 feet; measured from empirical observation when arresting a 15,000 lbs. vehicle from 30 MPH.

Referring now to the dissipation of kinetic energy controlled by applied inertia of the inertia blocks M1 and M2, each has compound moment arms, from the horizontal roll axis moment arm 1 and from the vertical turn axis moment arm. The power or force application at each lever arm of posts 10 and 11 has said dynamic locus 4 and the center of gravity of each mass has a corresponding locus as they shift from their initially deposed positions to their finally arrested positions (see FIGS. 9 and 11). The locii thereby establishes a triple compound rolling, turning and horizontally diagonal dragging movement of the inertial blocks M1 and M2. A feature is the angular momentum of the inertia blocks M1 and M2 as they are accelerated so that they converge and crush the vehicle body laterally from opposite sides.

In accordance with this invention, the movement and displacement of the mass M and/or M1 and M2 is impeded by the frictional interengagement of the bottom surface of frame 30 or frames 14 and 15, with the supporting planar surface of trafficway T, which depletes the kinetic energy released by the impacting vehicle as it is decelerated, and all of which is shown and described.

From the foregoing it will be seen and understood that the kinetic energy stored in the impacting vehicle is transferred through the rigid obstruction wall B or through the flexible tensioned obstruction member C and into controlled mass values, preferably comprised of a mass M or interconnected masses M1 and M2 that yield to the force applied. A feature of this invention is the in situ deposition of the integral mass M and barrier B first described and the separated inertia blocks M1 and M2 and obstruction member C second described. Both first and second embodiments rely upon above grade mass frictionally deposed upon the trafficway surface, and subject to simultaneous sliding or rolling; or turning and sliding motions impeded by mass acceleration and by the coefficient of friction properties of the above grade surface and/or pavement of the trafficway and resulting deceleration. Vehicle impact is at or near the center point 6 of the barrier B or obstruction member C, applying simultaneous forces which rapidly accelerates said mass M or blocks M1 and M2 followed by frictional deceleration, all of which comes to rest when motion of the vehicle is completely arrested.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. An above-grade trafficway barrier for arresting a vehicle of substantial mass traveling upon a roadway surface comprising:

a pair of barrier masses arranged in spaced-apart relationship and separated by said roadway surface;

said barrier masses having a frictional interface support slidably engageable on each side of said roadway surface so as to be movable in an angular direction with respect to said roadway surface and upon said roadway surface;

an elongated flexible barrier having a pair of opposite ends connected respectively to each of said barrier masses and having a midsection extending across said roadway surface;

said flexible barrier being subject to the transfer of kinetic energy applied thereto from the vehicle mass when impacting there against for movably drawing said barrier masses towards each other against inertial restraint and frictional restraint; and said pair of barrier masses are of equal size and weight so as to move in said angular direction at a similar speed and distance per second in a balanced manner in response to the vehicular mass when impacting against said midsection of said flexible barrier.

2. The barrier defined in claim 1 wherein:

said barrier masses are separated from each other to define a gap therebetween equal to a given width of said roadway surface; and said barrier masses closing said gap during impacting of the vehicle mass against said flexible barrier midsection.

3. The barrier defined in claim 2 wherein:

each of said barrier masses having a post embedded therein with each post terminating in a yoke; and a coupling pin carried by each yoke and said pins joining said barrier opposite ends to said barrier masses respectively.

4. The barrier defined in claim 3 wherein:

said flexible barrier is an elongated chain composed of interconnecting links terminating at each end of said chain in an end link coupled to said pin.

5. An above-grade trafficway barrier for arresting a vehicle of substantial mass traveling upon a roadway surface of a given width comprising:

a pair of barrier masses with each barrier mass having a slidable undersurface;

said barrier masses separated by said roadway surface and residing independently of each other in alignment adjacent to said roadway surface beyond said given width;

an elongated flexible barrier chain extending over and across said roadway surface and having a pair of terminating ends secured to said pair of barrier masses;

said flexible barrier chain adapted to move said pair of barrier masses towards each other in sliding relationship across said roadway surface in response to impacting engagement with said barrier chain by the vehicle; and said pair of barrier masses has a first passive position adjacent to opposite sides of said roadway surface and a second dynamic position sliding towards each other across said roadway surface when drawn by said flexible barrier chain.

6. The barrier defined in claim 5 wherein:

said barrier chain is rigid and taut in joining said pair of barrier masses when said pair of barrier masses are in said first possessive position; and said barrier chain is pliable and loose when said pair of barrier masses are in said second dynamic position so as to accept the shape of a vehicle mass impacting said flexible barrier chain.

* * * * *